United States Patent [19]

Bialkowski

[11] Patent Number: 4,500,968

[45] Date of Patent: Feb. 19, 1985

[54] PAPER MACHINE WET LINE CONTROL

[75] Inventor: Wojciech L. Bialkowski, Richmond Hill, Canada

[73] Assignee: Domtar Inc., Montreal, Canada

[21] Appl. No.: 393,457

[22] Filed: Jun. 29, 1982

[51] Int. Cl.[3] ..... G06F 15/46

[52] U.S. Cl. ..... 364/471; 364/556; 358/101; 358/107; 162/263; 162/252

[58] Field of Search ..... 364/471, 556; 358/101, 358/107; 162/259, 263, 252; 382/22, 28, 48; 250/202, 548, 561

[56] References Cited

U.S. PATENT DOCUMENTS

| | | | |
|---|---|---|---|
| 3,620,914 | 11/1971 | Rocheleau | 162/259 |
| 3,703,436 | 11/1972 | Rice | 162/259 |
| 3,886,036 | 5/1975 | Dahlin | 162/259 |
| 3,926,719 | 12/1975 | Spitz | 364/471 |
| 3,958,509 | 5/1976 | Murray et al. | 358/101 |
| 4,019,819 | 4/1977 | Lodzinski | 162/263 |
| 4,053,353 | 10/1977 | Leffler | 162/259 |
| 4,097,847 | 6/1978 | Forsen et al. | 382/22 |
| 4,142,105 | 2/1979 | Erdmann | 250/561 |
| 4,161,205 | 7/1979 | Justus | 162/259 |
| 4,243,925 | 1/1981 | Gnuechtel | 250/548 |
| 4,305,096 | 12/1981 | Yokoshima et al. | 358/101 |
| 4,352,125 | 9/1982 | Guth | 358/101 |
| 4,374,703 | 2/1983 | Lebeau et al. | 364/471 |

*Primary Examiner*—Jerry Smith
*Assistant Examiner*—Louis Woo
*Attorney, Agent, or Firm*—Antoine H. Gauvin

[57] ABSTRACT

A paper machine wet line monitor is provided by photographing the surface of the wire of a paper machine in the area of the wet line (sometimes known as the dry line) with a video camera to generate video signals. The video signals are digitized and define a line corresponding to the wet line of the machine and this line is displayed preferably while also indicating the average location of the wet line across the machine. The processed digitized signal may be imposed on an automatic headbox control to influence this control and maintain the position of the wet line.

4 Claims, 2 Drawing Figures

PAPER MACHINE WET LINE CONTROL

FIELD OF THE INVENTION

The present invention relates to a wet line (also known as the dry line) sensor, more particularly the present invention relates to an optical sensor for determining the location of the wet line on a paper machine, and the control of wet line position.

BACKGROUND TO THE INVENTION

The wet line is the line of demarkation between the portion of the stock on the paper machine wire submerged in water and the portion having fibres extending above the depth of the water. Looking down at an acute angle to the wire on a paper machine as it is running one can see the glossy area where the water extends above the surface of the stock and a matte area at the opposite end of the wire where sufficient water has drained through the stock so that the fibres project above the water line and form what appears to be a matte finish. A very clear line of demarkation exists at the transition from the glossy area where the water flooded right through the stock to the matted area where the water level is below that of the fibres of the stock.

The wet line is generally kept within a certain area on the paper machine, its location being dependent upon the consistency of the stock, the position of the headbox slice, the pressure in the head box, the speed of the wire and the amount of suction applied through the wire to remove the water. In any event this line of demarkation or wet line is generally located well down the paper machine wire and usually is in the vicinity of the suction boxes.

An operator generally adjusts the various flows to the head box, the slice opening and the machine speed in order to position the wet line in a desired location. For example, if the wet line is too far down the machine there is a good chance there will be a break between the couch and the presses; whereas if the wet line is too close to the head box, the stock is obviously being drained too quickly.

Despite the fact that the wet line is useful to the operator for optimizing the setting of the paper machine, no means have been hitherto available to detect the location of this line and thus the operator must leave his control position to visually inspect the machine and then return and manually manipulate the controls to attempt to adjust the machine operation to position the wet line in the desired location. When steady state operation is attained some adjustment is occasionally necessary as a result of stock freeness changes, however, when grade changes are made i.e. basis weight changes or fibre changes (or furnish changes), the location of the wet line tends to shift drastically. Such movement of the wet line provides an indication that the change over to the other grade is not proceeding smoothly and that difficulties are being encountered and monitoring the changes in the location of the wet line can provide a guide to the operator indicating what may be wrong.

BRIEF DESCRIPTION OF THE INVENTION

It is an object of the present invention to provide a means for detecting the wet line on a paper machine and its control.

Broadly, the present invention comprises means for generating video signals representing the surface of the wire of a paper machine in the area where the wet line is normally positioned, means for digitizing the video signals so generated to define a line of demarkation corresponding to the wet line on the machine, and means to display the line of demarkation derived from the video signal.

The digitized signal indicating the wet line position will be compared with a set point in a control computer which will influence the headbox flow control programs to control slice position and/or machine speed.

BRIEF DESCRIPTION OF THE DRAWINGS

Further features, objects and advantages will be evident from the following detailed description of the preferred embodiment of the present invention taken in conjunction with the accompanied drawings in which.

DESCRIPTION OF THE PREFERRED EMBODIMENTS

Figure 1:
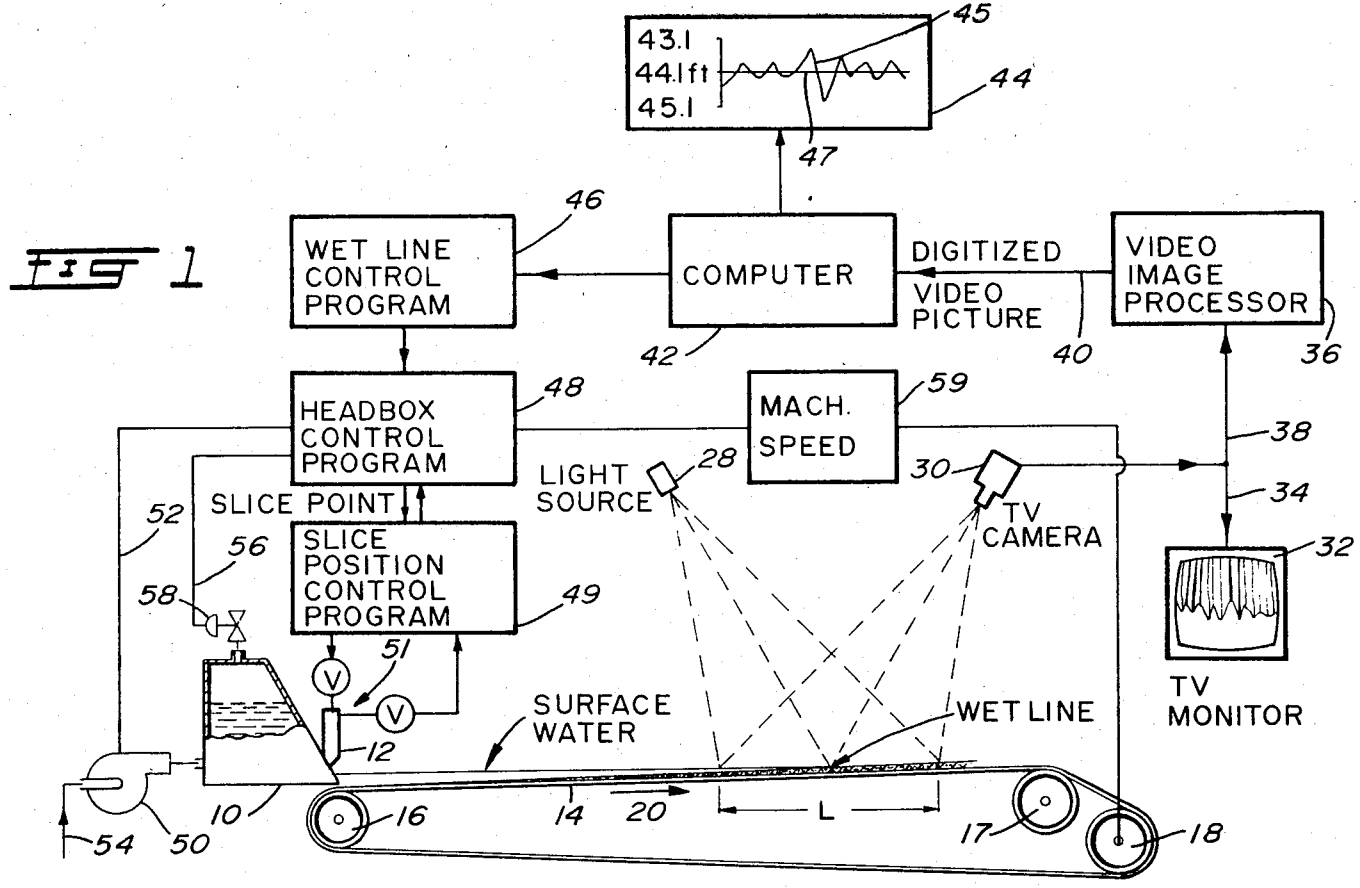
FIG. 1 is a side elevation schematically illustrating a paper machine and the monitoring and control system to the present invention.
Figure 2:
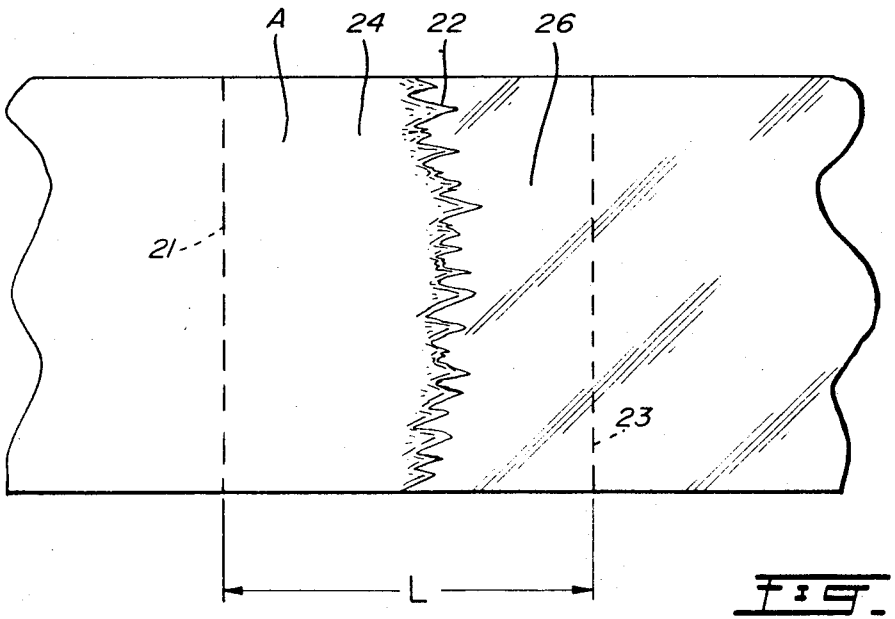
FIG. 2 is a plan view illustrating the wet line formed on the wire on the paper machine.

As shown in FIG. 1 the paper machine is composed of a headbox 10 having an adjustable slice 12 to adjust the opening through which the stock issues onto the surface of the wire 14 of the paper machine. The wire 14 passes over the breast roll 16 to the couch roll 17 and then its return over a driving roll 18 back to the breast roll 16. As the stock travels with the wire 14 in the direction of the arrow 20, water drains through the wire and leaves the fibres on the upper surface thereof. Eventually the level of the water draihs to below the surface of the fibres retained on the wire, at which point no water remains above the surface of the stock i.e. the fibres project above the surface of the stock. The dividing line between where the fibres are submerged and the drier area (where the fibres project above the surface of the water) provides a clear line of demarkation, which defines the wet line on the machine. Such a wet line is indicated at 22 in FIG. 2. It will be noted that to the left of this line the surface is glossy as indicated at 24 whereas to the right of this line the surface is more of a matte finish as indicated in 26. The line 22 is easily distinguished visually using the lighting that is generally available in the mill. However, when practising the present invention it is preferred, although not essential to further illuminate the surface of the wire at least in the area to be monitored. For this reason a suitable light source generally indicated at 28 is directed onto the surface of the wire to illuminate an area having a length L in the machine direction and preferably a width equal to the total width of the paper machine and that corresponds to the area generally indicated at A between the two dotted lines 21 and 23 at the extremities of the length L. This area A is monitored by the TV camera 30 mounted above the wire in a position to photograph the area A and detect the line 22 due to the difference in reflectence between the shiny or glossy area 24 where the web is full of water and the matte area 26. The illuminating light source 28 improves the sharpness of the line 22 to facilitate the operation of the equipment, however as above indicated it is not necessary. It is only necessary that the signal from the TV camera be capable of being manipulated (digitized) to detect the wet line and that the field of view be sufficiently wide to detect the wet line 22 when the wet line moves along the surface of the wire 14 within a permissible range. If the wet line moves off one extremity or the other of the area A, the means processing the signal can clearly indicate which direction the wet line has moved and alert the operator or assuming computer control is available to initiate steps to bring the wet line back to its required set position or alert the operator to the problem.

The video signal from the TV camera 30 is transferred into a TV monitor 32 via line 34 and to a video image processor 36 via line 38. The image processor 36 digitizes the image by coding each point of the frame based on its brightness (or grayness), thus permitting an analyzer (often a part of this image processor) to discriminate between the different shades, thereby discerning the wet line. The digitized signal is transferred to computer or the like 42 and may be displayed on a suitable display unit 44 indicating the location and configuration of the line of demarkation 45 between the glossy surface and the matte surface i.e. the wet line so that the operator may see this line 45 on the control computer display.

The computer will also be used to define the set point for the position of the wet line 45, in the illustrated arrangement 44.1 feet. The computer may also indicate the average position of the wet line which is shown by the line 47 and calculate the standard deviation about this average position. If the average location of the line deviates from the set point the wet line control program schematically indicated at 46 will modify or act with the head box control program normally indicated at 48 to adjust the flows to the headbox.

Normally the head box control program 48 will control the set point for the slice position operated by the slice position control program 49 to adjust the position of the slice 12 via the mechanism schematically indicated at 51. The control program 48 generally would also control the ratio of jet speed to wire speed by controlling the head box total head (total pressure at the wire) and liquid level. These objectives are met by the joint control of the fan pump 50 via a line schematically illustrated at 52 (thereby to adjust the amount of white water pumped from the white water pit and passing through line 54 and returned to the head box 10 which will change if the slice position is changed), and the control of the air pod pressure in the head box 10 which is adjusted by the air supply or air bleed valve 58 via line 56. The machine speed controller schematically indicated at 59 normally adjusts machine speed to meet other production criteria. The head box control program 48 adjusts the jet speed in order to maintain the desired jet to wire ratio in response to changes in machine speed. In so doing, the head box control program will vary the flow to the head box which in turn will effect the wet line.

The simplest manner for the wet line control program to function is to change the set point of the slice position control program 49 to adjust the position of the slice 12 i.e. if the wet line moves toward the head box and the slice will be opened which in turn would result in the fan pump 50 speeding up and diluting the stock i.e. increase the amount of white water from line 54 fed to the head box and thus increase the amount of water that has to be drained, tending to shift the wet line toward the couch roll 17. If the wet line is too far along the wire toward the roll 17 the opposite procedure may be used i.e. the slice 12 closed slightly which will slow the fan pump.

It will also be noted that the wet line may also be adjusted by adjusting the machine speed to provide more or less drainage time (drainage or suction applied by the foils is to some extent determined by the speed of the wire which obviously also effects drainage rate). However, adjustment of the machine speed is generally carried to maximize production for a given basis weight with the maximum being determined by other machine limitations, such as dryer capacity etc.

It is also possible to adjust the wet line position by changing the vacuum applied in some of the suction boxes, but such vacuum adjustments are normally not made.

The invention preferably will be used to provide an automatic control for the paper machine to act in conjunction with the other automatic controls particularly during paper grade changes, but it also is extremely useful to the operator for manual operation as it provides accurate up to date information on wet line position in the control room to improve manual operation of the paper machine.

Having described the invention, modifications will be evident to those skilled in the art without departing from the spirit of the invention as defined in the appended claims.

I claim:

1. A method for continuously monitoring the position of the wet line on a paper machine comprising continuously generating a video signal representing the surface of a wire of said paper machine in the area where the wet line is normally located, digitizing the video signal so generated to provide a digitized signal, processing said digitized signal to define a line corresponding to the wet line on the machine, and displaying the wet line defined by said processed digitized video signal.

2. A method as defined in claim 1 further comprising further processing said processed digitized signal to determine the average position of said wet line across the machine and displaying to said average position of said wet line.

3. A method as defined in claim 2 further comprising feeding a reference signal representing said average position of said headbox computer control in accordance with the said average position of said wet line to maintain said average position of said wet line at a fixed postion.

4. A method as defined in claim 3 wherein said reference signal adjusts a set point of a slice position control of said headbox computer control when said average position of said wet line changes.

* * * * *